US007618292B1

(12) United States Patent
Lin et al.

(10) Patent No.: US 7,618,292 B1
(45) Date of Patent: Nov. 17, 2009

(54) AUDIO PLUG ADAPTER AND METHOD FOR MANUFACTURING THE SAME

(75) Inventors: Chu Geng Lin, Tu-Cheng (TW); Ming Chia Chi, Tu-Cheng (TW); Ter-Hua Hsu, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/222,467

(22) Filed: Aug. 11, 2008

(51) Int. Cl.
*H01R 25/00* (2006.01)

(52) U.S. Cl. ..... 439/640; 439/131

(58) Field of Classification Search ..... 439/640, 439/638, 171, 173, 131, 165, 31
See application file for complete search history.

(56) References Cited

U.S. PATENT DOCUMENTS 6,478,628 B1 * 11/2002 Ming ..... 439/668
7,035,126 B1 * 4/2006 Lanni ..... 363/142
7,298,627 B2 * 11/2007 Hussaini et al. ..... 361/753
7,438,574 B2 * 10/2008 Neumann ..... 439/172
2006/0214511 A1 * 9/2006 Dayan ..... 307/38
2006/0276236 A1 * 12/2006 Krieger et al. ..... 455/573
2007/0202724 A1 * 8/2007 Neumann ..... 439/172

* cited by examiner

*Primary Examiner*—Neil Abrams
*Assistant Examiner*—Phuong Nguyen
(74) *Attorney, Agent, or Firm*—Rosenberg, Klein & Lee

(57) ABSTRACT

An audio plug adapter has a sleeve, an audio plug assembly rotatable coupled to the sleeve, a female connector received in the sleeve and a cable interconnected between the audio plug assembly and the female connector. The sleeve has a first coupling means formed the radial direction thereat, and a supporting platform extended outwardly and formed with a groove. The audio plug assembly has a rotatory base, an audio plug having a soldering portion received in the rotatory base and a contact portion, and a second coupling means formed on the rotatory base and perpendicular to the audio plug, which is rotatable coupled to the first coupling means of the sleeve. The contact portion of the audio plug of the plug assembly can be rotated received in the groove of the supporting platform of the sleeve to prevent that the contact portion is scraped by external force.

19 Claims, 6 Drawing Sheets

AUDIO PLUG ADAPTER AND METHOD FOR MANUFACTURING THE SAME

BACKGROUND OF THE INVENTION

1. Field of the Invention

The invention relates to the field of adapter, especially an audio plug adapter and a method for manufacturing the audio plug adapter.

2. The Related Art

According to the progress of the electrical technology, many audio products are used nowadays, such as MP3 players, MP4 players, CD players and etc. An audio plug adapter is one of accessories to the audio products.

A conventional audio plug adapter is disclosed in U.S. Pat. No. 5,139,444 filed in 1991 Sep. 17. The audio plug adapter disclosed by this patent includes a tip contact member and a sleeve member assembly. The tip contact member has a tapered tip component disposed at a first end thereof. Disposed at a second, distal end of the tip contact member is a conductor contact member and a ground contact member. The tip contact member further includes a mating portion disposed axially between the tapered tip component and the conductor and ground contact members.

The sleeve member assembly has a mating portion adapted for mating with the mating portion of the tip contact member. The sleeve member assembly has an opening portion defined at an end thereof. In this case, a cable connected to both the conductor contact member and the ground contact member of the tip contact member is passed through the opening portion of the sleeve member assembly and extended outwardly. Therefore, the other end of the cable is connected to an electrical product for transmitting audio signal.

In other case, the opening portion has arranged an audio female connector therein. A cable is received in the sleeve member assembly and connected to the conductor contact member and the ground contact member of the tip contact member and the audio female connector.

Because the tip contact member is exposed to external environment, the tip contact member is easily scraped by external force. The audio signal transmitted through the tip contact member of the audio plug adapter is unstable because the tip contact member got the scrape thereon.

SUMMARY OF THE INVENTION

An object of the present invention is to provide a plug adapter which includes a sleeve. The sleeve has a first opening formed in an axial direction thereof, a second opening formed in a radial direction thereof and communicating the first opening, and an inner space communicating both of the first opening and the second opening.

The adapter also includes a supporting platform extended outwardly from a side of the sleeve. The supporting platform is spaced away from the second opening. The supporting platform has a groove penetrated to an outer surface thereon, and the extending direction of the groove is substantially orthogonal to the extending direction of the second opening.

The adapter also includes a plug assembly coupled to the sleeve. The assembly includes a plug having a contact portion and a soldering portion, and a rotatory base rotatably coupled into the second opening of said sleeve. The soldering portion is received in the rotatory base, the contact portion is capable of entering into or departing from the groove under the rotatory base rotating. The adapter also includes a female connector having an opening and received in the inner space of the sleeve. The opening is surrounded by the first opening of the sleeve. A cable interconnects the soldering portion and the female connector.

A method for manufacturing the plug adapter includes following steps:

First step: One end of the cable is soldered to the soldering portion of the plug;

Second step: The plug and the cable are injection-molding with a first resin to form the plug assembly, wherein the first resin is molded to form the rotatory base;

Third step: The other end of the cable is soldered to the female connector; and

Fourth step: The plug assembly, the cable and the female connector are injection-molding with a second resin, wherein the second resin is molded to form the sleeve which encloses the female connector, the cable and a part of the rotatory base of the plug assembly, the first resin and the second resin are excluded to each other.

Therefore, the plug assembly is rotated with respect to the sleeve. The contact portion of the plug of the plug assembly can be rotated outwardly from the groove of the supporting platform of the sleeve in the operating state. Furthermore, the contact portion of the plug of the plug assembly can be rotatably received in the groove of the supporting platform of the sleeve in the retracting state to prevent that the contact portion is scraped by external force.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
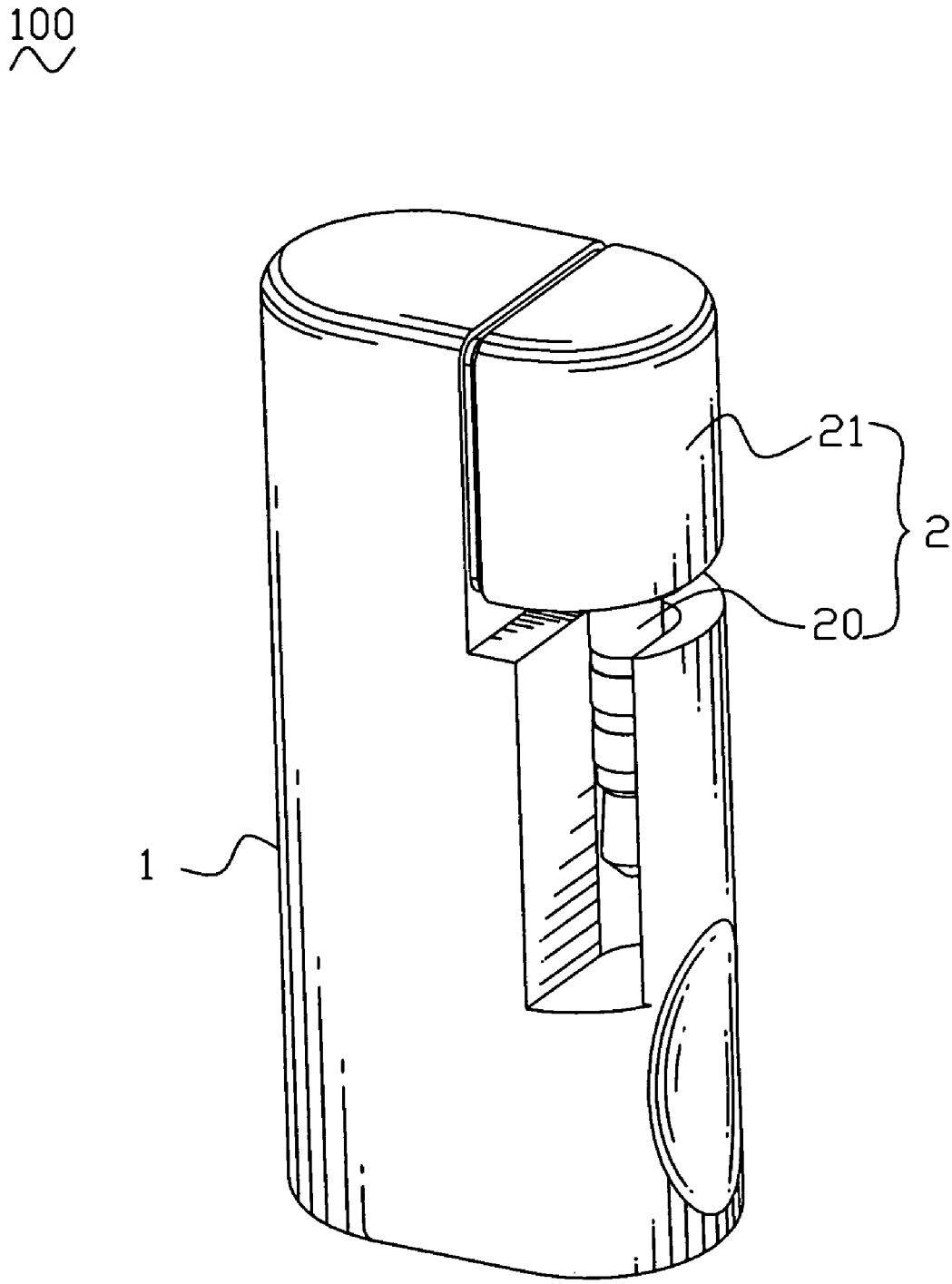
FIG. 1 is a perspective view showing a preferred embodiment of a plug adapter according to the present invention.
Figure 2:
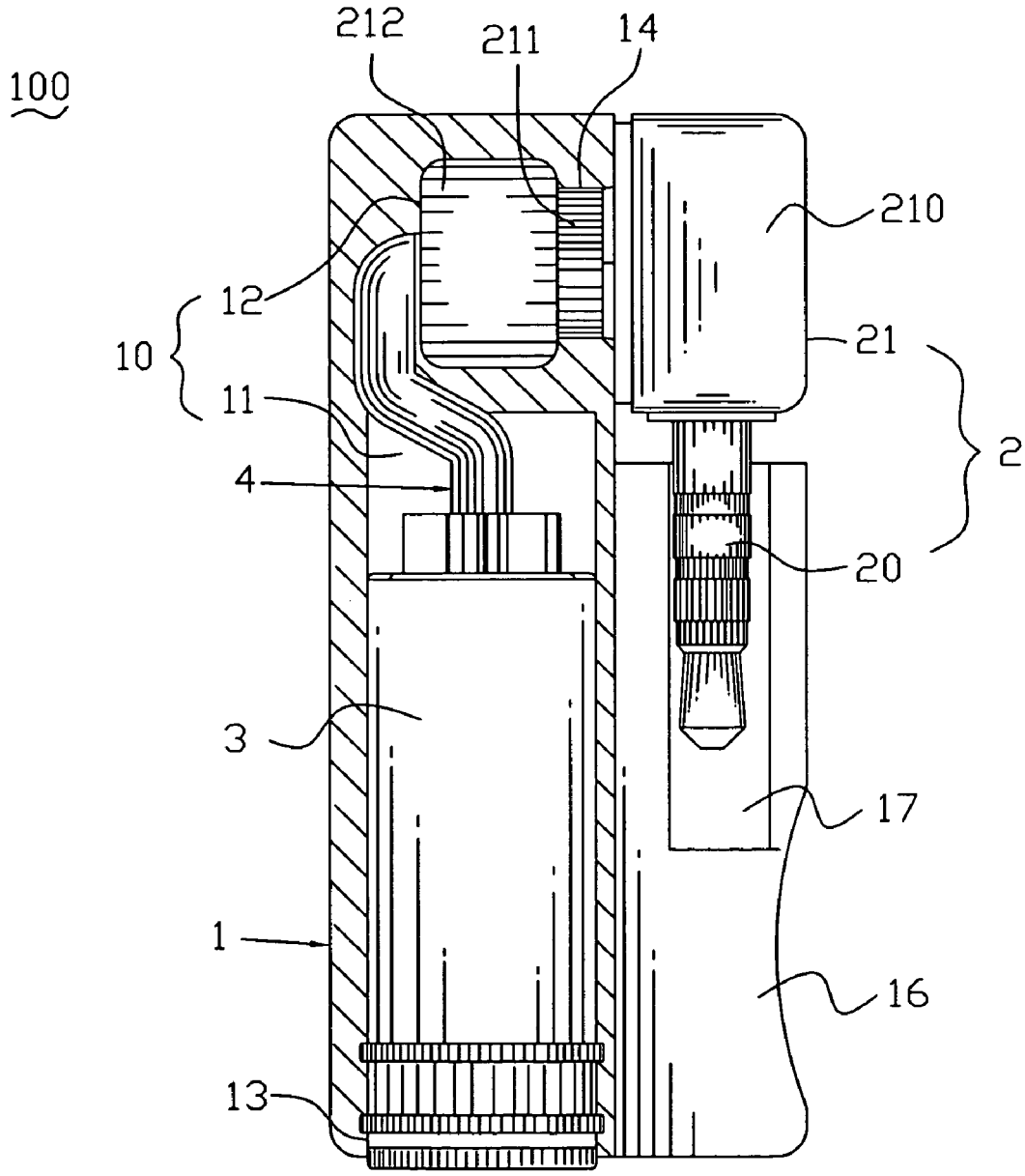
FIG. 2 is a cross section showing a sleeve of the plug adapter according to the present invention.

Please refer to FIG. 1 and FIG. 2, a preferred embodiment of a plug adapter 100 is shown. In this case, the plug adapter 100 is an audio plug adapter. The audio plug adapter 100 has a sleeve 1, an audio plug assembly 2, an audio female connector 3 and a cable 4. In this case, the sleeve 1 is made of thermoplastic elastomer. The sleeve 1 has an inner space 10. In this case, the inner space 10 of the sleeve 1 includes a first portion 11 and a second portion 12 communicating with the first portion 11.

Figure 3:
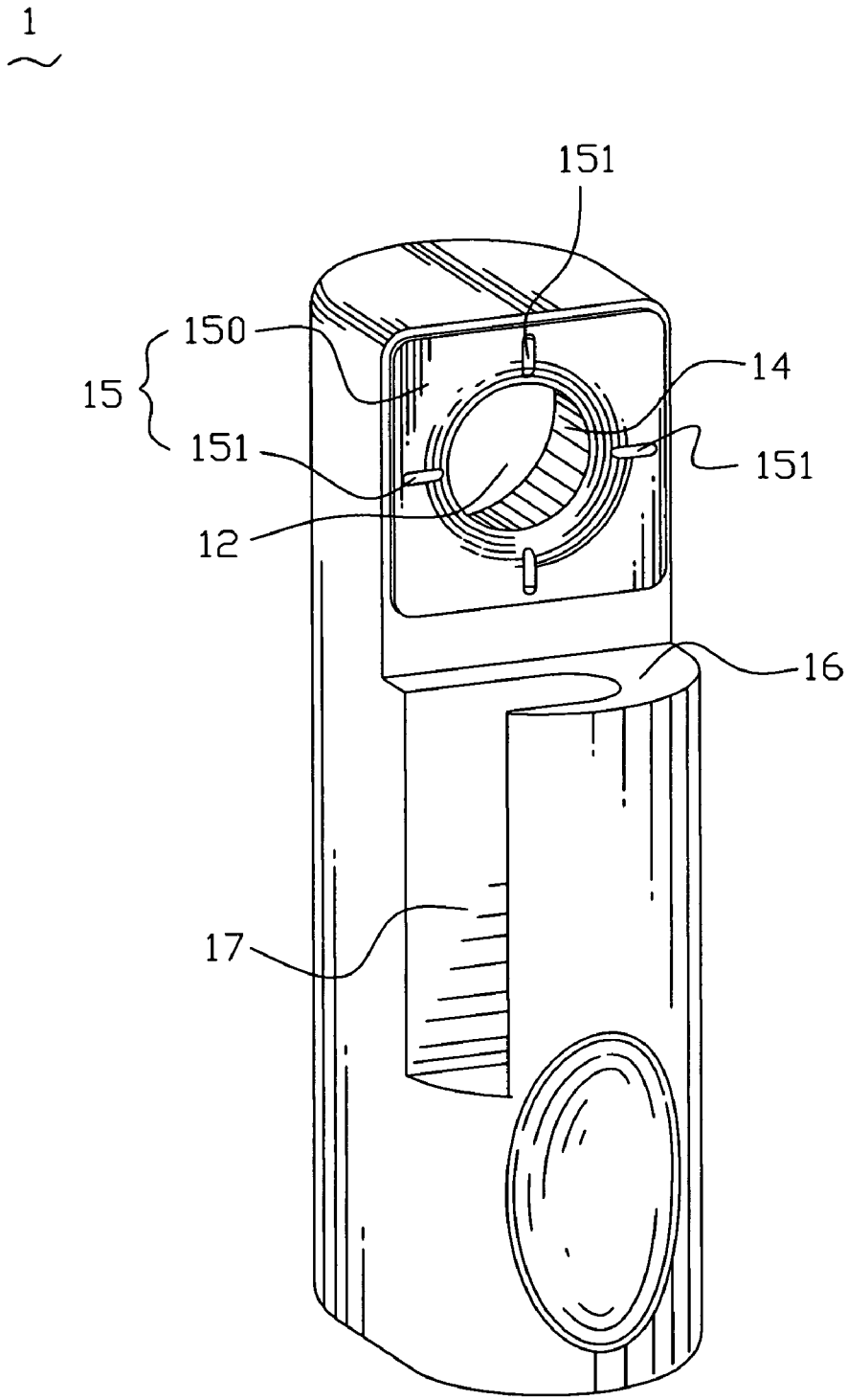
FIG. 3 is a perspective view showing the sleeve of the plug adapter according to the present invention.

Please refer to FIG. 2 and FIG. 3. The sleeve 1 further has a first opening 13 defined along axial direction of the sleeve 1 and communicating outside at a bottom portion of the sleeve 1, and a second opening 14 defined along radial direction thereof. In this case, the first opening 13 communicates the first portion 11 of the inner space 10 while the second opening 14 communicates the second portion 12 of the inner space 10.

In this case, the first opening 13 and the second opening 14 are both formed as a circular-shape. Moreover, the diameter of the second opening 14 is smaller than that of the second portion 12 of the inner space 10.

The sleeve 1 also has a first positioning mechanism 15 arranged at the periphery of the second opening 14. In this case, the first positioning mechanism 15 has a first matching surface 150 formed on the sleeve 1. The second opening 14 is opened on the first matching surface 150. In this case, the first matching surface 150 is a planar surface. A plurality of cavities 151 are formed on the first matching surface 150 and arranged along the circumferential direction of the second opening 14.

A supporting platform 16 is extended outwardly from the sleeve 1. In addition, the supporting platform 16 is integrated with the sleeve 1 to form as one piece. A groove 17 is formed in the supporting platform 16 and runs along axial direction of the sleeve 1. The groove 17 communicates with the outside along axial direction and radial direction of the supporting platform 16. The supporting platform 16 is formed as a semi-cylindraceous shape. In this case, the groove 17 of the supporting platform 16 is parallel the inner space 10 of the sleeve 1.

Figure 4:
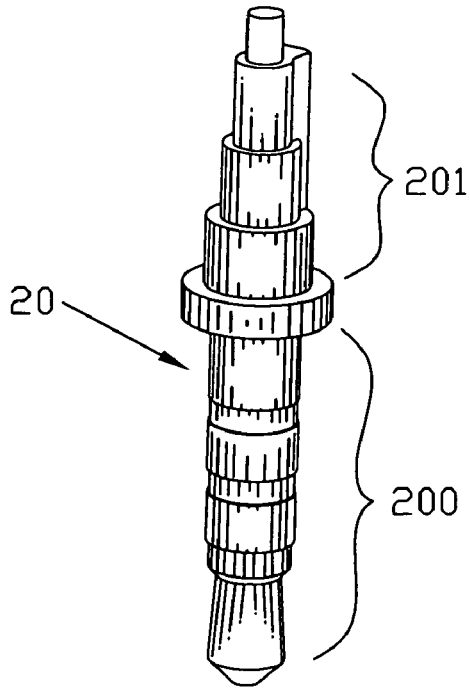
FIG. 4 is a perspective view showing a plug of the plug adapter according to the present invention.
Figure 5:
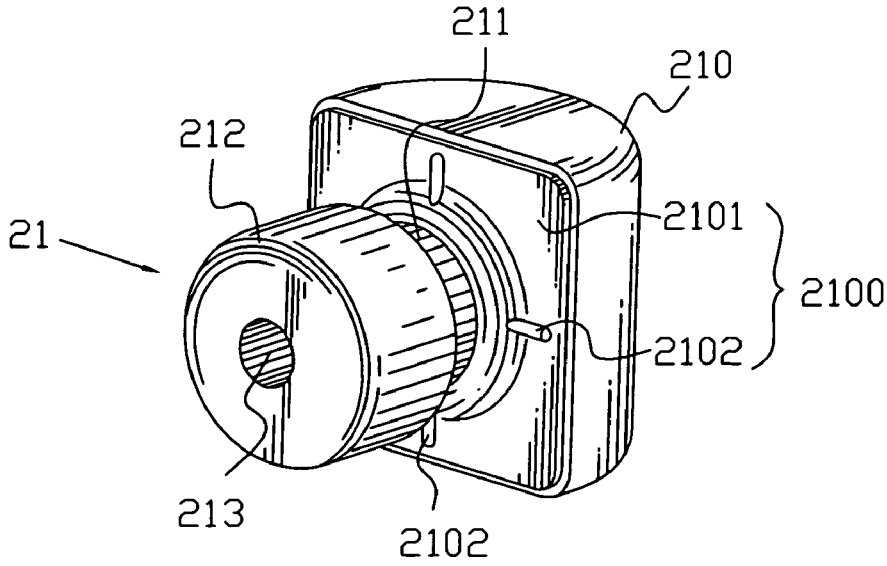
FIG. 5 is a perspective view showing a rotatory base of the plug adapter according to the present invention.

Please refer to FIG. 2, FIG. 4 and FIG. 5. The audio plug assembly 2 includes an audio plug 20 and a rotatory base 21 for mounting the plug 20 thereon. The audio plug 20 has contact portion 200 at one end and a soldering portion 201 at the other end thereof. In this case, the contact portion 200 has a metallic contact tip, a plurality of annular metallic tubes and a plurality of insulating rings between the contact tip and the metallic tube and between the metallic tubes. The soldering portion 201 is formed as four cylindrical segments along the axis of the audio plug 20.

The rotatory base 21 is formed to include a base portion 210, a neck portion 211 and a head portion 212. The neck portion 211 narrower than the head portion 212 is formed between the base portion 210 and the head portion 212. The base portion 210 is formed to have an inner space for receiving the soldering portion 201 of the audio plug 20. In this case, the base portion 210 is formed of polypropylene and formed as a semi-cylindraceous shape corresponding to the supporting platform 16.

In this case, the nick portion 211 and the head portion 212 are also formed as a cylindraceous-shape. The diameter of the nick portion 211 is smaller than that of the head portion 212. An aperture 213 is formed within the neck portion 211 and the head portion 212 and communicates with the inner space of the base portion 210.

The base portion 210 has a second positing mechanism 2100 arranged at the periphery of the neck portion 211. The second positioning mechanism 210 has a second matching surface 2101 corresponding to the first matching surface 150 of the first position mechanism 15 of the sleeve 1. The neck portion 211 is formed on the second matching surface 2101 of the second positioning mechanism 210. A plurality of the projections 2102 are formed on the second matching surface 150 and arranged along the circumference of the neck portion 211.

Please refer to FIG. 2 again. In assembly, the plug assembly 2 is coupled to the sleeve 1. The first position mechanism 15 of the sleeve 1 is coupled to the second position mechanism 2100 of the base portion 210 of the rotatory base 21 of the plug assembly 2. In this case, the first matching surface 150 of the first position mechanism 15 is urged against the second matching surface 2101 of the second position mechanism 2100. The projections 2101 of the second position mechanism 2100 are wedged into the cavities 151 of the first position mechanism 150.

The neck portion 211 of the rotatory base 21 of the plug assembly 2 is rotatably coupled to the second opening 14 of the sleeve 1. The head portion 212 of the rotatory base 21 of the plug assembly 2 is rotatably received in the second portion 12 of the inner space 10 of the sleeve 1. The contact portion 200 of the audio plug 20 of the plug assembly 2 is received in the groove 17 of the supporting platform 16 of the sleeve 1.

The audio female connector 3 is received in the first portion 11 of the inner space 10 of the sleeve 1. The opening of the audio female connector 3 is surrounded by the first opening 13 of the sleeve 1. A matching plug may be inserted into the audio female connector 3 through the first opening 13 of the sleeve 1. The cable 4 interconnects the audio plug 20 of the plug assembly 2 and the audio female connector 3, and received in the sleeve 1 and the plug assembly 2.

In this case, one end of the cable 4 is received in the aperture 213 within the neck portion 211 and the head portion 212, and the inner space of the base portion 210, which is soldered to the soldering portion 201 of the audio plug 20. The other end of the cable 4 is passed through the second portion 12 and the first portion 11 of the inner space 10 and soldered to the audio female connector 3.

Figure 6:
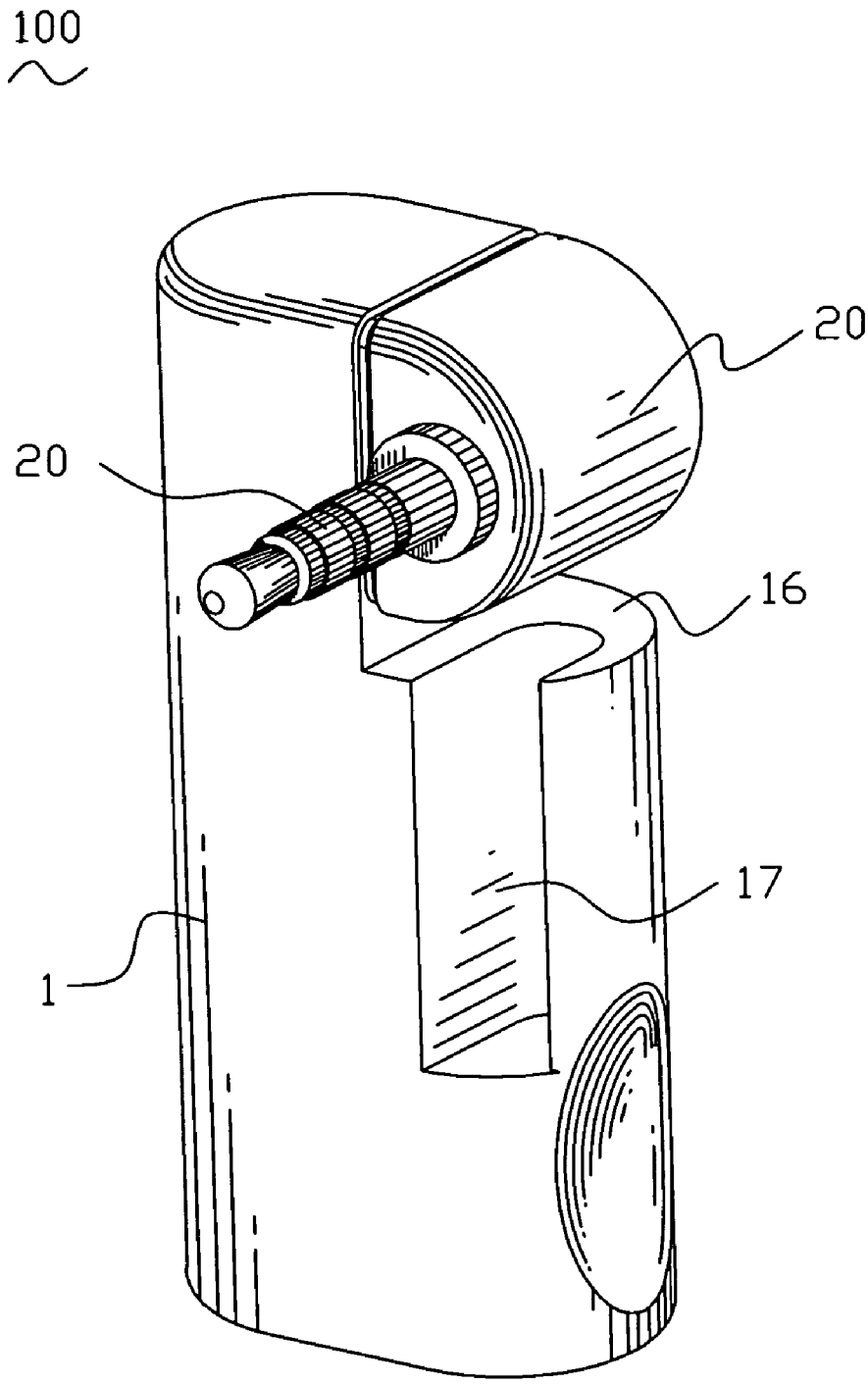
FIG. 6 is a perspective view showing the plug adapter in the operating state.

Please refer to FIG. 6. Therefore, the audio plug assembly 2 is rotated with respect to the sleeve 1 a certain angle e.g 90 degrees. In this case, when the audio plug adapter 100 is in the operating state, the audio plug assembly 2 is rotated to clockwise direction and the audio plug 20 of the audio plug assembly 2 is rotated away from the groove 17 of the supporting platform 16 of the sleeve 1 and exposed transversely. The projections 2102 of the second positioning mechanism 2100 of the audio plug assembly 2 are rotated on the first matching surface 150 along clockwise direction and then jammed into the corresponding cavities 151 of the first positioning mechanism 15 of the sleeve 1 for retaining the audio plug adapter 100 in the operating state.

When the audio plug adapter 100 is in the retracting state, the audio plug assembly 2 is rotated to anticlockwise direction and the audio plug 20 of the audio plug assembly 2 is rotated to be received in the groove 17 of the supporting platform 16 of the sleeve 1. The projections 2102 of the second positioning mechanism 2100 of the audio plug assembly 2 are rotated on the first matching surface 150 along anticlockwise direction and then jammed into the corresponding cavities 151 of the first positioning mechanism 15 of the sleeve 1 for retaining the audio plug adapter 100 in the retracting state.

Figure 7:
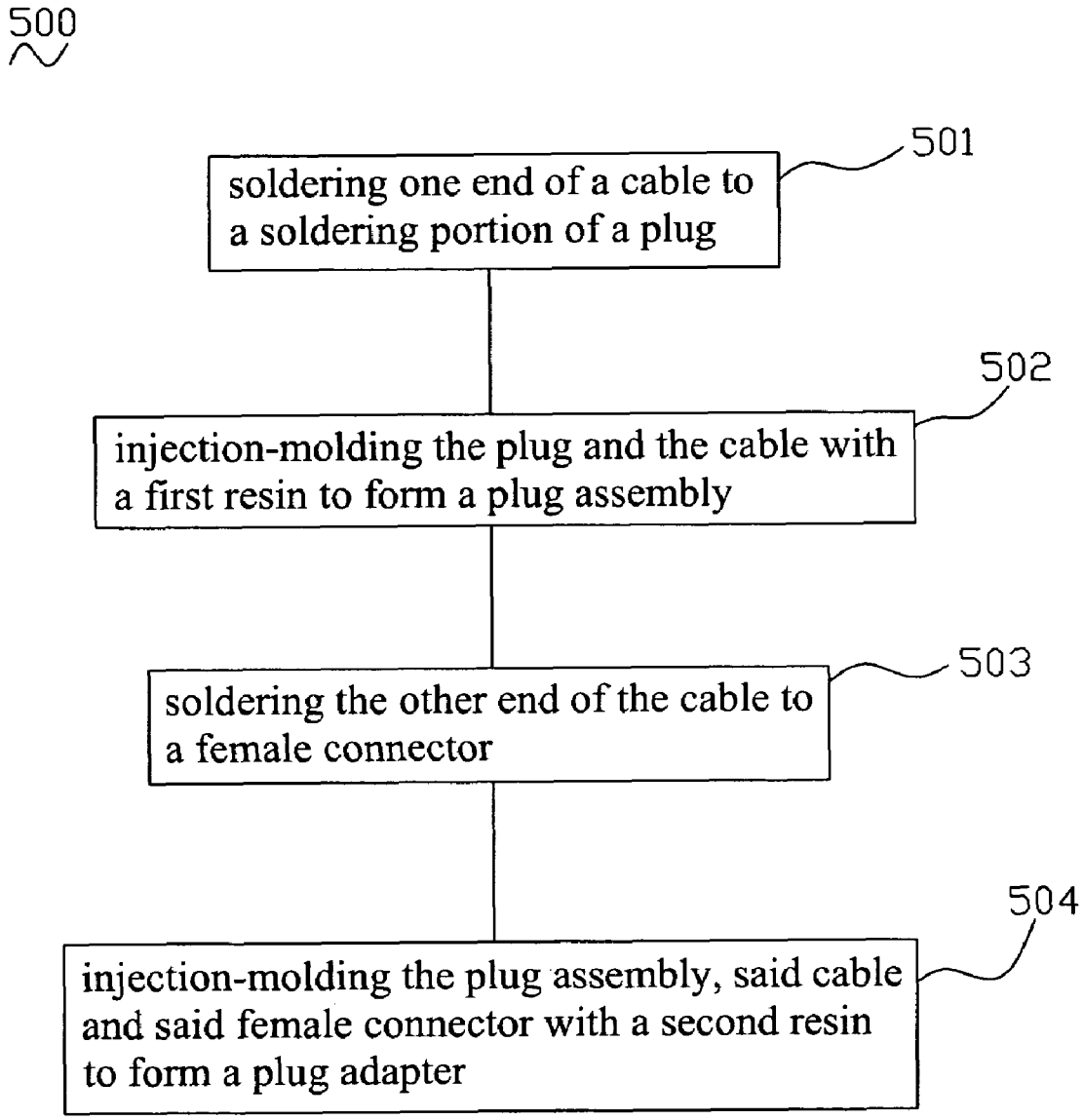
FIG. 7 is a flow chart of a method for manufacturing the plug adapter according to the present invention.

Please refer to FIG. 7. A method 500 for manufacturing the audio plug adapter 100 includes following steps:

- step 501: soldering one end of the cable 4 to the soldering portion 201 of the audio plug 20.
- step 502: the audio plug 20 and the cable 4 are injection-molding with a first resin to form the audio plug assembly 2, and the first resin is molded to form the rotatory base 21 enclosing the soldering portion 201 of the audio plug 20 and one end of the cable 4.
- step 503: soldering the other end of the cable 4 to the audio female connector 3.
- step 504: the audio plug assembly 2, the cable 4 and the audio female connector 3 are injection-molding with a second resin to form the audio plug adapter 100, and the second resin is molded to form the sleeve 1 enclosing the audio female connector 3, the cable 4 and the neck portion 211 and the head portion 212 of the rotatory base 21 of the audio plug assembly 2.

In the method 500 described above, the first resin and the second resin are repulsed to each other. Therefore, the sleeve 1 and the audio plug assembly 2 are formed as two pieces. In this case, the first resin is polypropylene and the second resin is thermoplastic elastomer.

Therefore, the contact portion 200 of the audio plug 20 of the audio plug assembly 2 is received in the groove 17 of the supporting platform 16 of the sleeve 1 to prevent that the contact portion 200 is scraped by external force. Accordingly, the audio signal is stably transmitted through the contact portion 200 of the audio plug 20 of the audio plug assembly 2 of the audio plug adapter 100.

Furthermore, the present invention is not limited to the embodiments described above; various additions, alterations and the like may be made within the scope of the present invention by a person skilled in the art. For example, respective embodiments may be appropriately combined.

What is claimed is:

1. An audio, comprising:

a sleeve having a first opening formed in an axial direction thereof, a second opening formed in a radial direction thereof and communicating the first opening, and an inner space communicating both of said first opening and said second opening;

a supporting platform extending outwardly from one side of said sleeve, wherein said supporting platform is spaced away from said second opening, said supporting platform having a groove communicating outside, an extending direction of said groove being substantially orthogonal to an extending direction of said second opening;

a plug assembly coupled to said sleeve, having a plug having a contact portion and a soldering portion, and a rotatory base rotatably coupled into said second opening of said sleeve, said soldering portion being received in said rotatory base, said contact portion being capable of entering into or departing from said groove under said rotatory base rotating;

a female connector having an opening and received in said inner space of said sleeve, the opening being surrounded by said first opening of said sleeve; and a cable interconnecting said soldering portion and said female connector.

2. The plug adapter as claimed in claim 1, wherein said plug of said plug assembly is an audio plug, said female connector is an audio female connector.

3. The plug adapter as claimed in claim 1, wherein the inner space of said sleeve comprises a first portion communicating said first opening and receiving said female connector therein, and a second portion communicating said first portion and said second opening, the width of said second opening is smaller than that of said second portion of said inner space.

4. The plug adapter as claimed in claim 3, wherein said rotatory base comprises a base portion, a head portion and a neck portion sandwiched between said base portion and said head portion, said soldering portion is received in said base portion, said neck portion and said head portion are rotatably received in said second opening and said second portion respectively, while said neck portion and said head portion are perpendicular to said plug.

5. The plug adapter as claimed in claimed 4, wherein an aperture is defined in both said neck portion and said head portion, and one end of said cable is passed through said aperture and soldered to said soldering portion of said plug of said plug assembly.

6. The plug adapter as claimed in claim 5, further comprising a position means arranged between said sleeve and said plug assembly.

7. The plug adapter as claimed in claim 6, wherein said position means has a first positioning mechanism arranged at the periphery of said second opening of said sleeve, and a second positing mechanism arranged at the periphery of said neck portion of said rotatory base of said plug assembly.

8. The plug adapter as claimed in claim 7, wherein said first positioning mechanism has a first matching surface formed on said sleeve and surrounding said second opening, and a plurality of cavities formed on said first matching surface, said second positioning mechanism having a second matching surface corresponding to said first matching surface of said first position mechanism, and a plurality of projections formed on said second matching surface and corresponding to said cavities of said first position mechanism, and said neck portion formed on said second matching surface of the second positioning mechanism.

9. An Audio, comprising:

a sleeve having a side surface, a first coupling means formed on said side surface, an inner space formed in the sleeve, a supporting platform extending outwardly on said side surface and spaced away from said first coupling means, and a groove formed in said supporting platform and penetrated to an outer surface of said supporting platform, an extending direction of said groove substantially being orthogonal to an extending direction of said second opening;

a plug assembly coupled to said sleeve, having a rotatory base having a second coupling means which is rotatably coupled to said first coupling means of said sleeve, a plug having a contact portion capable of entering into or departing from said groove under said rotatory base rotating, and a soldering portion received in said rotatory base, which is perpendicular to said second coupling means of said rotatory base;

a female connector received in said inner space of said sleeve; and a cable interconnecting said soldering portion of said plug of said plug assembly and said female connector, one part of said cable being received in said sleeve while the other part of said cable being received in said rotatory base.

10. The plug adapter as claimed in claim 9, wherein said plug of said plug assembly is an audio plug, and said female connector is an audio female connector.

11. The plug adapter as claimed in claim 9, wherein said first coupling means has an opening opened on said side surface of said sleeve, a coupling space formed in said sleeve and interconnecting said inner space and said opening, and the width of said opening is smaller than said width of said coupling space.

12. The plug adapter as claimed in claim 11, wherein said second coupling means has a neck portion formed on said rotatory base and a head portion formed on said neck portion, said head portion and said neck portion are rotatably received in said coupling space and said opening of said first coupling means of said sleeve respectively.

13. The plug adapter as claimed in claim 12, further comprising a position means arranged between said sleeve and said plug assembly.

14. The plug adapter as claimed in claim 13, wherein said position means has a first positioning mechanism arranged at the periphery of said first coupling means, and a second positing mechanism arranged at the periphery of said second coupling means.

15. The plug adapter as claimed in claim 14, wherein said first positioning mechanism has a first matching surface formed on said sleeve, and a plurality of cavities formed on said first matching surface.

16. The plug adapter as claimed in claim 15, wherein said second positioning mechanism has a second matching surface corresponding to said first matching surface of said first position mechanism, and a plurality of projections is formed on said second matching surface and corresponds to said cavities of said first position mechanism.

17. The plug adapter as claimed in claim 16, wherein said neck portion of said second coupling means is formed on said second matching surface, and said opening of said first coupling means is opened on said first matching surface of said first positioning mechanism.

18. A method for manufacturing an audio plug adapter, comprising:

soldering one end of a cable to a soldering portion of a plug;

injection-molding said plug and said cable with a first resin to form a plug assembly, wherein said first resin is molded to form a rotatory base of said plug assembly which encloses said soldering portion of said plug and said end of said cable;

soldering the other end of said cable to a female connector; and injection-molding said plug assembly, said cable and said female connector with a second resin, wherein said second resin is molded to form a sleeve which encloses said female connector, said cable and a port of said rotatory base of said plug assembly;

wherein said first resin and said second resin are different from each other.

19. The method as claimed in claim 18, wherein said first resin is polypropylene and said second resin is thermoplastic elastomer.

* * * * *